United States Patent [19]

Lahr et al.

[11] Patent Number: 4,957,692

[45] Date of Patent: Sep. 18, 1990

[54] APPARATUS FOR HANDLING A FUEL ELEMENT SKELETON

[75] Inventors: Helfrid Lahr, Wedemark; Bernd Pontani, Alzenau, both of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 438,025

[22] Filed: Nov. 20, 1989

Related U.S. Application Data

[62] Division of Ser. No. 249,964, Sep. 27, 1988, Pat. No. 4,923,668.

[30] Foreign Application Priority Data

Oct. 2, 1987 [DE] Fed. Rep. of Germany ..... 3733387
Feb. 2, 1988 [DE] Fed. Rep. of Germany ..... 3802966

[51] Int. Cl.[5] ..... G21C 19/00
[52] U.S. Cl. ..... 376/260; 100/218
[58] Field of Search ..... 376/260, 261, 272; 100/218, 229 R, 229 A, 226, 227, 249, 902; 252/626, 633; 414/146

[56] References Cited

U.S. PATENT DOCUMENTS

| | | | |
|---|---|---|---|
| 3,706,209 | 12/1972 | Gehlen et al. | 100/218 |
| 3,948,167 | 4/1976 | De Feudis | 100/218 |
| 4,511,499 | 4/1985 | Meuschke et al. | 376/261 |
| 4,537,711 | 8/1985 | Wilhelm et al. | 252/626 |
| 4,590,000 | 5/1986 | Baatz et al. | 252/633 |
| 4,841,853 | 6/1989 | Wallace | 100/218 |

*Primary Examiner*—Daniel D. Wasil
*Attorney, Agent, or Firm*—Walter Ottesen

[57] ABSTRACT

The invention relates to an apparatus for handling a fuel element skeleton of an irradiated nuclear reactor fuel element from which the fuel rods have been removed. The fuel element skeleton is placed horizontally in a compacting shaft of a ram-type press in order to obtain a simple and reliable compaction of the skeleton. After the compacting shaft is closed, the fuel element skeleton is compacted against a press base. The compacted fuel element skeleton is pushed out of the compacting shaft and into a transportable transfer shaft. The loaded transfer shaft is removed from the ram-type press and transported away to a transfer loading location.

3 Claims, 2 Drawing Sheets

FIG. 1
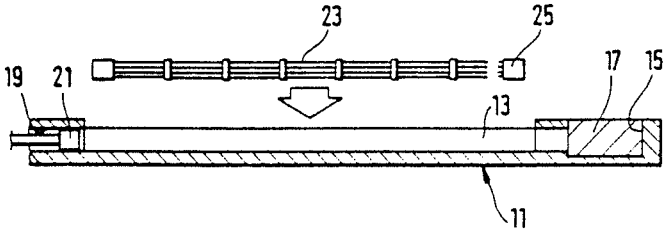
FIG. 2
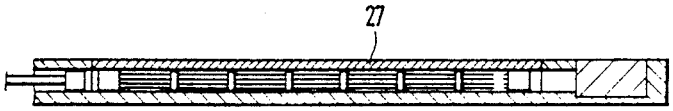
FIG. 3
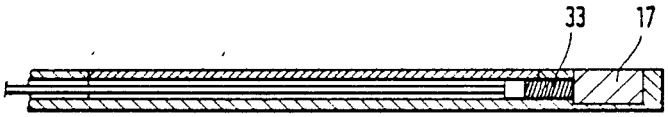
FIG. 4
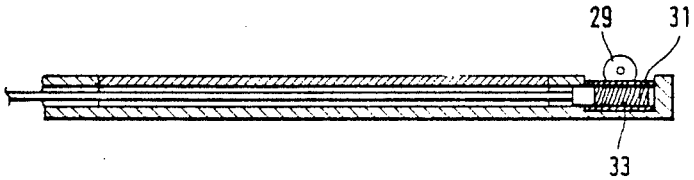
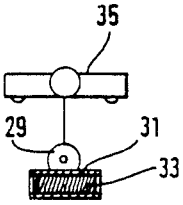
FIG. 5
FIG. 6
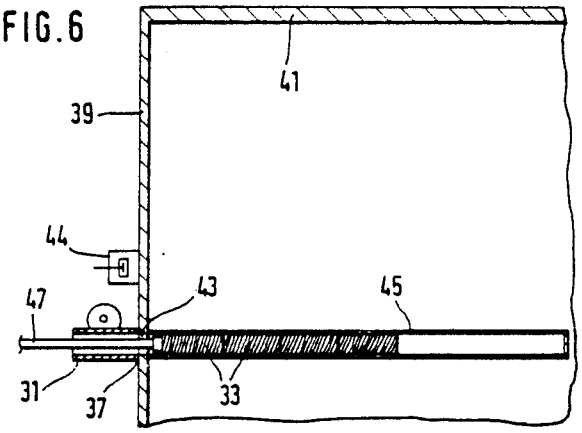

APPARATUS FOR HANDLING A FUEL ELEMENT SKELETON

This is a division of application Ser. No. 249,964, filed Sept. 27, 1988, now U.S. Pat. No. 4,923,668.

FIELD OF THE INVENTION

The invention relates to a method and apparatus for handling a fuel element frame or skeleton of an irradiated nuclear reactor fuel element from which the fuel rods have been removed.

BACKGROUND OF THE INVENTION

European patent application No. 0,066,695 corresponds to U.S. Pat. applications 268,225 (filed May 29, 1981) and 268,311 (filed May 29, 1981) and discloses an apparatus for pulling individual fuel rods from irradiated fuel elements which are removed and stored after a certain period of irradiation. In addition to the fuel rods, the fuel element frame remains which constitutes the structural parts of the fuel element. The fuel rods are either cut for a follow-up reprocessing or are loaded into special storage containers. In this connection, reference may be made to the publication "Atomwirtschaft", Feb. 1970, page 90. The fuel element frame must be channelled for storage and must be placed in a container suitable for storage.

U.S. Pat. No. 4,680,159 discloses a storage container for accommodating individual fuel rods with a special insert basket which is provided for accommodating scrap which occurs when the fuel rods are separated from the fuel element. The insert basket is accommodated in the center of a square shaft in the container. The structural parts of the fuel element are filled into the quadratic center shaft.

For the economic use of containers receiving radioactive material and radioactive contaminated articles, it is advantageous to compact the fuel element frame in order to obtain a reduction in volume.

German Patent No. 3,213,497 discloses a method for compacting crushed radioactive waste materials wherein compaction occurs in a container made of sheet steel. The container is filled with the crushed radioactive waste materials and is thereafter provided with a cover made of sheet steel and compacted to a steel encased body. Although this method is usable for crushed radioactive material, it cannot be carried out with respect to fuel element frames which have a length of almost five meters.

SUMMARY OF THE INVENTION

It is an object of the invention to provide a method of the kind described above by means of which a simple compaction of a fuel element frame is possible and by means of which the pressed packet can be handled.

The method of the invention is for handling a fuel element skeleton of an irradiated nuclear reactor fuel element from which the fuel rods have been removed. The method of the invention includes the steps of: placing the fuel element skeleton in a compacting shaft of a ram-type press, the compacting shaft defining a longitudinal axis and the ram-type press having a removable press base part disposed at one end of the compacting shaft; shaft, the base part having a predetermined length measured in the direction of the longitudinal axis compacting the fuel element skeleton in the direction of the axis against the press base part so as to form a compacted fuel element frame; skeleton; removing the press base part from the ram-type press and replacing the press base part with a transportable transfer shaft open at both ends, the transfer shaft having a length corresponding substantially to the length of the base part; pushing the compacted fuel element skeleton from out of the compacting shaft and into the transportable transfer shaft seated in the ram-type press; and, removing the loaded transfer shaft from the ram-type press and transporting the loaded transfer shaft away therefrom.

The fuel element is pressed together against the base of the compacting shaft in the longitudinal direction of the latter. After compaction, the pressed packet or compaction unit is pushed into a transfer shaft in the form of a pipe segment and is transported out and away from the press. The pipe segment encloses the pressed packet so that broken frame pieces remain secure and a volume expansion by means of a relaxation of the pressed packet is prevented. The consistency of size of the pressed packet which is obtained is advantageous for the further method steps.

The compacting shaft has an upwardly facing opening and a removable cover for covering the opening. According to another feature of the invention, the method includes the further steps of: holding the fuel element frame in the horizontal position while placing the same in the compacting shaft through the upwardly facing opening; and, then placing the cover over the opening before compacting the fuel element frame in the direction of the longitudinal axis of the compacting shaft.

Thus, the fuel element frame can be brought into position above the opened compacting shaft by means of a block and tackle which is usually available in the cell of the nuclear facility wherein the method of the invention is performed. The fuel element frame is then lowered into the compacting shaft. The compacting shaft is then closed over its length.

The ram-type press can include a removable compacting shaft having an open end face. In addition, the housing of the press can define a seat for accommodating the removable compacting shaft when the latter is placed in the press. The method of the invention then includes the further steps of: holding the compacting shaft at a location spaced from the housing and pushing the fuel element frame horizontally into the compacting shaft through the open end face thereby loading the latter; and, then placing the loaded compacting shaft on the seat of the housing before compacting the fuel element frame. With these method steps, the compacting shaft can be removed from the ram-type press so that the fuel element frame can be pushed into the compacting shaft at the open end face thereof with the compacting shaft being closed about its periphery over its length. Thereafter, the compacting shaft is returned to the ram-type press and the compacting operation is carried out. A wear of the compacting shaft at its upper longitudinal side is prevented with this embodiment.

The steps of the method of the invention are performed in a cell of a nuclear facility having a cell wall. This cell wall preferably has a pass-through opening through which the compacted fuel element frames are passed out of the cell. According to still another embodiment of the invention, the method can include the further steps of: bringing the loaded transfer shaft to the pass-through opening so that the transfer shaft is aligned with a storage canister placed at the pass-through opening on the outer side of the cell wall, the storage container having dimensions which permit a plurality of compacted fuel element frames to be accommodated therein; and, pushing the compacted fuel element frame out of the transfer shaft, through the pass-through opening and into the storage canister.

In this embodiment of the invention, a storage canister or another storage container is brought from the outside to the loading wall while the transfer shaft is docked from the inside so as to be in alignment. The pressed packet is reliably and with the required dimensions introduced into the storage canister from the transfer shaft. This canister does not have to be brought into the hot cell wherein the compaction process takes place. The storage canister is disposed in a contamination free atmosphere and can therefore be handled further without expensive protective measures.

The invention also relates to an apparatus for carrying out the method of the invention. The apparatus is a ram-type press and includes: an elongated housing having a compacting shaft for receiving the uncompacted fuel element therein; the compacting shaft having first and second longitudinal open ends; a removable press base part; the housing having a seat formed therein directly adjacent the first longitudinal open end for accommodating the press base part therein; a ram displaceably mounted in the housing so as to be movable through the second longitudinal open end and into the compacting shaft for compacting the fuel element frame against the press base part to form a compacted frame packet; and, a transfer shaft having a receiving space therein for accommodating the compacted frame packet and being placeable into the seat after removal of the press base part, the transfer shaft having a receiving opening facing and aligned with the first longitudinal open end when disposed in the seat; and, the ram being displaceably mounted so as to be further displaceable into the compacting shaft for pushing the compacted frame packet out of the compacting shaft and into the receiving space of the transfer shaft.

The compacting shaft corresponds to the length of a fuel element frame which requires a length of approximately five meters for pressure water reactors. The ram is displaceable along the longitudinal axis of the compacting shaft and, after the compacting shaft has been loaded, presses the fuel element frame against the press base part. The fuel element frame is compacted to reduce volume. The press base part is removed after the compaction operation and a pipe-shaped transfer shaft is seated in the space of the press base part so as to be aligned with the compacting shaft. A further displacement of the ram causes the press packet to be pushed into the transfer shaft. The transfer shaft is thereby free and the pressed packet can be removed with the transfer shaft out of the end region of the ram-type press.

According to another embodiment of the invention, the compacting shaft can be fixedly arranged within the ram-type press and can be opened and closed at its upper longitudinal side.

According to still another embodiment of the invention, the ram-type press can be provided with a removable compacting shaft into which the fuel element frame is insertable at an open end face thereof. The loaded compacting shaft is again seated in the ram-type press and is bounded at one end by the ram and at the other end by the press base part.

BRIEF DESCRIPTION OF THE DRAWINGS

The invention will now be explained with reference to the drawings wherein:

FIG. 1 is a side elevation view of the ram-type press according to the invention wherein the press is shown being loaded with a fuel element frame or skeleton and wherein the compaction shaft is shown open along its upper longitudinal side;

FIG. 2 shows the loaded press with the compacting shaft closed;

FIG. 3 shows the closed press with a compacted fuel element frame in the form of a pressed packet;

FIG. 4 shows the press packet after it has been pushed into a pipe-shaped transfer shaft;

FIG. 5 shows the transport of the transfer shaft by means of an overload crane;

FIG. 6 shows the insertion of the pressed packet into a storage canister through a loading opening in a cell wall; and, FIG. 7 is an alternate embodiment of the ram-type press according to the invention wherein the latter is provided with a compacting shaft which is removable and is completely enclosed on its longitudinal sides.

DESCRIPTION OF THE PREFERRED EMBODIMENTS OF THE INVENTION

Figure 7:
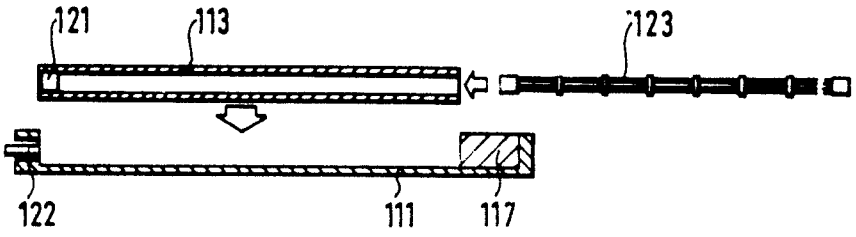

The ram-type press 11 has a compacting shaft 13 having a length of approximately five meters in its press bed. At the end of the compacting shaft 13, a press base part 17 is seated in a recess 15 and is removable in the upward direction. The press base part 17 covers the end face of the compacting shaft 13. At the other end of the compacting shaft 13, a displaceable press ram 21 is provided in a guide 19 which can be force loaded. A fuel element frame 23 is shown horizontally disposed over the open compacting shaft 13 (FIG. 1) and is shown with one head piece 25 separated therefrom. The fuel element frame 23 is placed with the head piece 25 in the compacting shaft 13.

The compacting shaft 13 is closed with a cover plate 27 as shown in FIG. 2 and the ram 21 is charged. The fuel element frame 23 is compacted as shown in FIG. 3 by the longitudinal movement of the ram 21 with the compaction occurring in the absence of a buckling of the frame 23.

After compaction, the press base part 17 is removed upwardly from the recess 15. A transfer shaft 31 provided with a crane loop 29 is seated in the vacated recess 15. The transfer shaft 31 is a metal pipe piece as shown. The pressed packet 33 is pushed into the transfer shaft 31 by means of a further displacement of the ram 21 in the compacting shaft 13 (FIG. 4).

The transfer shaft 31 with the pressed packet 33 inserted therein is taken up by an overhead crane 35 at the crane loop 29 (FIG. 5) and brought to a docking location 37 at a cell wall 39 of a caisson closed off with respect to the cell (FIG. 6). At this location, a loading opening 43 is cleared by displacing a closure 44 when an elongated storage canister 45 is docked at the opposite side of the wall. The transfer shaft 31 is docked so that it is in alignment with the storage canister 45. The pressed packet is pushed out of the transfer shaft 31, through the loading opening 43 in the wall 39 and into the storage canister 41 by means of an aligned ram 47. As shown in FIG. 6, the storage canister 45 can take up several pressed packets 33 one after the other.

FIG. 7 shows another embodiment of the ram-type press according to the invention where the press is indicated by reference numeral 111. This modified ram-type press 111 includes a compacting shaft 113 which is closed all around on its longitudinal sides and the end faces of which are again open. The compacting shaft 113 is therefore loaded with a fuel element frame 123 outside of the ram-type press 111 and can be seated between the press unit and the press base part 117 while in the loaded condition.

The press unit includes a loosely guided ram 121 which is mounted at the end of the compacting shaft 113. In the built-in condition of the compacting shaft 113, the ram 121 can be force loaded by a piston-cylinder unit via a piston rod 122.

It is understood that the foregoing description is that of the preferred embodiments of the invention and that various changes and modifications may be made thereto without departing from the spirit and scope of the invention as defined in the appended claims.

What is claimed is:

1. A ram-type press apparatus for compacting a fuel element skeleton of an irradiated nuclear reactor fuel element from which the fuel rods have been removed, the fuel element skeleton having a predetermined uncompacted length, the ram-type press comprising:

an elongated housing having a compacting shaft for receiving the uncompacted fuel element skeleton therein;

said compacting shaft having first and second longitudinal open ends;

a removable pres base part;

said housing having a seat formed therein directly adjacent said first longitudinal open end for accommodating said press base part therein;

a ram displaceably mounted in said housing so as to be movable through said second longitudinal open end and into said compacting shaft for compacting the fuel element skeleton against said press base part to form a compacted skeleton packet; and, a transfer shaft having a receiving space therein for accommodating the compacted skeleton packet and being placeable into aid seat after removal of said press base part, said transfer shaft having a receiving opening facing and aligned with said first longitudinal open end when disposed in said seat; and, said ram being displaceably mounted so as to be further displaceable into said compacting shaft for pushing the compacted skeleton packet out of said compacting shaft and into said receiving space of said transfer shaft.

2. The ram-type press apparatus of claim 1, said compacting shaft being a fixed part of said housing and defining an elongated top opening through which the uncompacted fuel element skeleton is passed when said compacting shaft is loaded therewith; and, a cover for covering said top opening after said compacting shaft is loaded with the uncompacted fuel element skeleton.

3. The ram-type press apparatus of claim 1, said compacting shaft being removable from said housing so as to permit loading said compacting shaft with the uncompacted fuel element skeleton through one of said open ends while said compacting shaft is removed from said housing.

* * * * *